US006167826B1

(12) United States Patent
Funato

(10) Patent No.: US 6,167,826 B1
(45) Date of Patent: Jan. 2, 2001

(54) DEVICE FOR SUPPLYING UPPER THREAD OF SEWING MACHINE

(75) Inventor: Nobuhiko Funato, Nagoya (JP)

(73) Assignee: Brother Kogyo Kabushiki Kaisha, Aichi-Ken (JP)

( * ) Notice: Under 35 U.S.C. 154(b), the term of this patent shall be extended for 0 days.

(21) Appl. No.: 09/293,782

(22) Filed: Apr. 20, 1999

(30) Foreign Application Priority Data

Apr. 20, 1998 (JP) ..... 10-109342

(51) Int. Cl.[7] ..... D05B 47/00
(52) U.S. Cl. ..... 112/302
(58) Field of Search ..... 112/302, 278, 112/254; 73/160; 57/315, 90, 903; 28/288

(56) References Cited

U.S. PATENT DOCUMENTS 3,982,490 * 9/1976 Bury ..... 112/80.7
5,022,335 * 6/1991 Hanyu et al. ..... 112/302 X
5,042,405 * 8/1991 Bradley et al. ..... 112/80.7
5,467,724 * 11/1995 Bardsley et al. ..... 112/80.7

FOREIGN PATENT DOCUMENTS

419814 * 3/1965 (CH) ..... 112/302
1-111581 U 7/1989 (JP) .

* cited by examiner

*Primary Examiner*—Ismael Izaguirre
(74) *Attorney, Agent, or Firm*—Oliff & Berridge, PLC

(57) ABSTRACT

An upper thread supply device includes a drive roller 50 and two slave rollers 52, 54. The slave roller 52 has a thread contacting portion 52*a* formed from a soft metal. The slave roller 54 has a thread contacting portion 54*a* formed from a resilient material. The drive roller 50 is formed from a hard metal. A thread is supplied by the upper thread supply device following a thread feed pathway. The drive roller 50 and the soft metal thread contacting portion 52*a* sandwich the thread at one position along the thread feed pathway and the drive roller 50 and the resilient thread portion 54*a* sandwich the thread at a separated position along the thread feed pathway. The resilient thread contacting portion 54*a* is positioned downstream from the position where the thread is sandwiched by the hard metal thread contacting portion 54*a* and the soft metal thread contacting portion 52*a*. The hard metal thread contacting portion of the drive roller 50 and the soft metal thread contacting portion 52*a* sandwich the thread and prevent it from being excessively drawn out from the thread spool by vertical movement of a thread take-up lever. The hard metal drive roller 50 and the resilient thread contacting portion 54*a* mainly reliably feed out the upper thread by sandwiching the upper thread there-between.

47 Claims, 7 Drawing Sheets

DEVICE FOR SUPPLYING UPPER THREAD OF SEWING MACHINE

BACKGROUND OF THE INVENTION

1. Field of the Invention

The present invention relates to an upper thread supply device having a drive roller driven by a drive motor and a slave roller disposed in contact with the drive roller. The drive roller and the slave roller hold a thread there-between and feed the thread by rotation of the drive roller.

2. Description of the Related Art

Japanese Utility-Model-Application Publication (Kokai) No. HEI-1-111581 discloses an upper thread supply device with a drive roller and two slave rollers that all extend parallel to each other. The slave rollers are disposed adjacent to the drive roller. Drive force from a motor is transmitted to the drive roller by gears. A thread is sandwiched between the drive roller and the slave rollers, and fed out by rotation of the drive roller.

FIG. 1 shows another conventional upper thread supply device. The device includes a drive roller 158 fixed to the drive shaft of a drive motor 148, and two slave rollers 170, 170. The two slave rollers 170, 170 have the same shape and are formed from the same material, that is, a thermoplastic rubber. One is disposed upstream, and the other is disposed downstream, with respect to a thread-feed direction. The drive roller is made entirely of non-quench-hardened iron. The slave rollers 170, 170 are prevented from falling off support members 158 by stopper rings 159. A thread held between the drive roller 158 and slave rollers 170, 170 is transported by rotation of the drive roller 158.

The surface of the drive roller has a low friction coefficient. When oil or dust cling to the outer surface of the drive roller, the thread can slip so that the upper thread cannot be properly fed out. Also, the slave rollers have low friction with respect to the upper thread, so they cannot suitably hold the upper thread when the rollers are stopped. This can result in excessive upper thread being drawn out from the thread spool, resulting in tangling of the upper thread, or in defective stitches. Therefore, a separate electrical magnetic solenoid is provided in order to properly hold the upper thread when the rollers have stopped.

To improve the above-described configuration, a quench hardened metal has been used as the thread contacting portion of the drive roller and a hard resin has been used as the thread contacting portion of the two slave rollers. Using this configuration improves the ability of the rollers to properly hold the thread when the rollers are in a stopped condition.

SUMMARY OF THE INVENTION

However, the upper thread is not stably feed out when both of the slave rollers have the same configuration. Improper thread feed has an adverse effect on stitches.

Also, when a quench-hardened metal is used for the drive roller, the resin slave rollers are quickly worn down to a smooth surface and are not very durable. That is, because the resin thread contacting portions of slave rollers are quickly worn down to a low friction coefficient, they are incapable of stably feeding out the upper thread. As a result of the unstable thread feed, the upper thread can slip and carve into the resin thread contacting portion of the slave rollers. Grooves and scratches formed in the thread contacting portions causes the upper thread to break or cause improper holding of the upper thread. When the upper thread slips, tangling thread can result.

It is an object of the present invention to overcome the above-described problems and provide an upper thread supply device capable of performing proper thread holding and proper thread feed.

In order to achieve the above-described objective, an upper thread supply device according to one aspect of the present invention includes a drive roller driven to rotate by a drive source; a first slave roller disposed in a contact with the drive roller; and a second slave roller disposed in a contact with the drive roller, wherein hardness of the first slave roller and hardness of the second slave roller are different from each other.

With this configuration, the thread is fed by cooperative operation between the drive roller and two slave rollers with different hardnesses. The harder slave roller serves to prevent excessive thread from being drawn from the spool by operation of the thread take up lever, for example. The softer slave roller serves to proper feed the thread. Therefore, the two different roles are properly performed and the thread can be accurately fed.

According to another aspect of the present invention, a drive roller and a slave roller in contact with the drive roller have different hardnesses. This is achieved by using a quench-hardened metal for the thread contacting portion of one and a non-quench-hardened metal for the other. Because both are formed from metal, they can properly hold the upper thread when the rollers are not rotating. Because one is softer than the other, the thread can be accurately fed.

Alternatively, the drive roller and the slave roller can have different hardnesses by providing one with a thread contacting portion formed from a quench-hardened metal and the other with a thread contacting portion formed from a resilient material. With this configuration, the thread can be properly fed.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE EMBODIMENT

Figure 1:
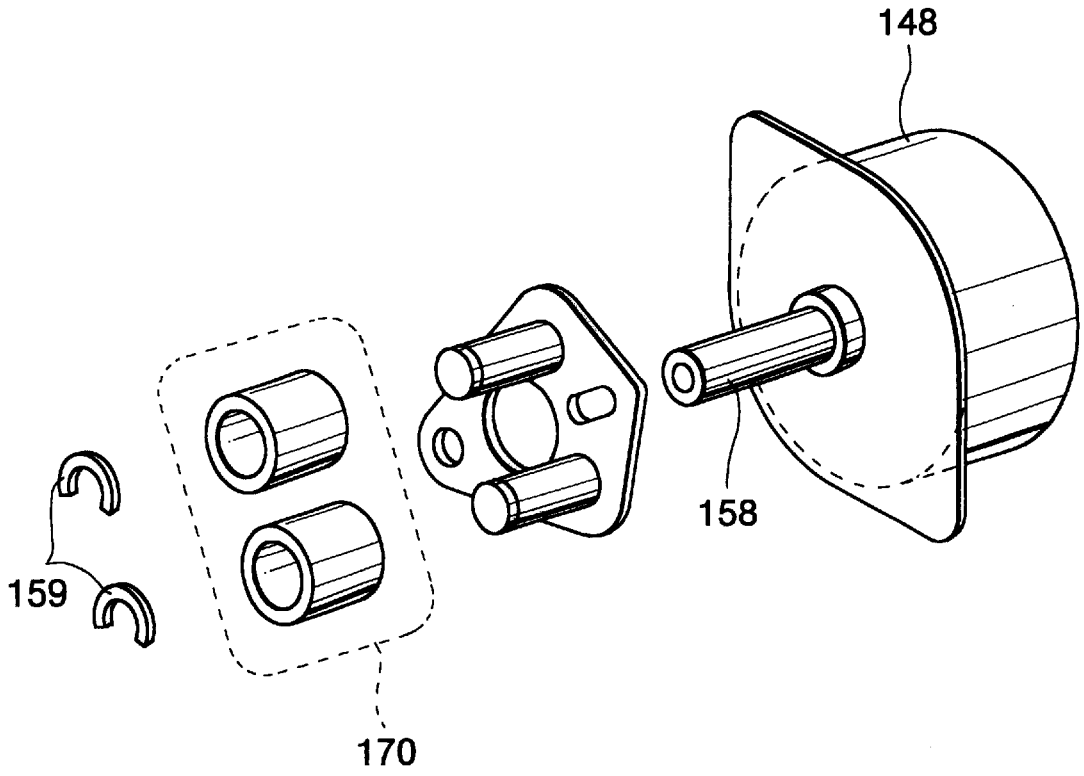
FIG. 1 PRIOR ART
FIG. 1 is an exploded prospective view of a conventional upper thread supply device.

An upper thread supply device 1 according to an embodiment of the present invention will be described while referring to the accompanying drawings wherein like parts and components are designated by the same reference numerals to avoid duplicating description.

Figure 2:
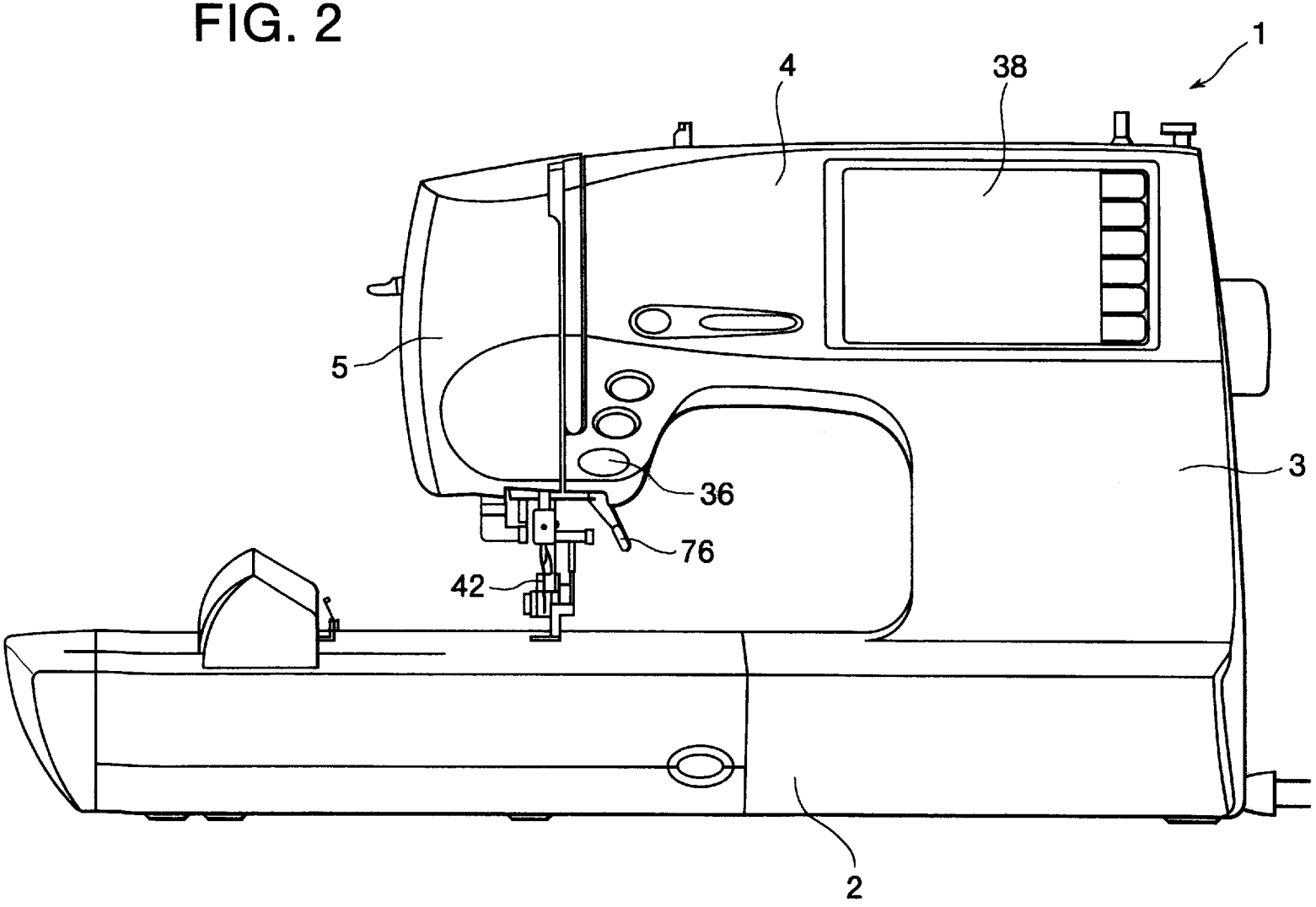
FIG. 2 is a side view of a sewing machine according to an embodiment of the present invention.

FIG. 2 shows a sewing machine 1. The sewing machine 1 includes a bed 2, a column 3 extending upward from the bed 2, an arm 4 extending from the column 3 over the bed 2, and a head 5 connected to a free end of the arm 4. The sewing machine 1 also includes a start/stop key 36 for starting and stopping sewing operations, and a liquid crystal display 38 for displaying settings and warning messages, for example.

Figure 3:
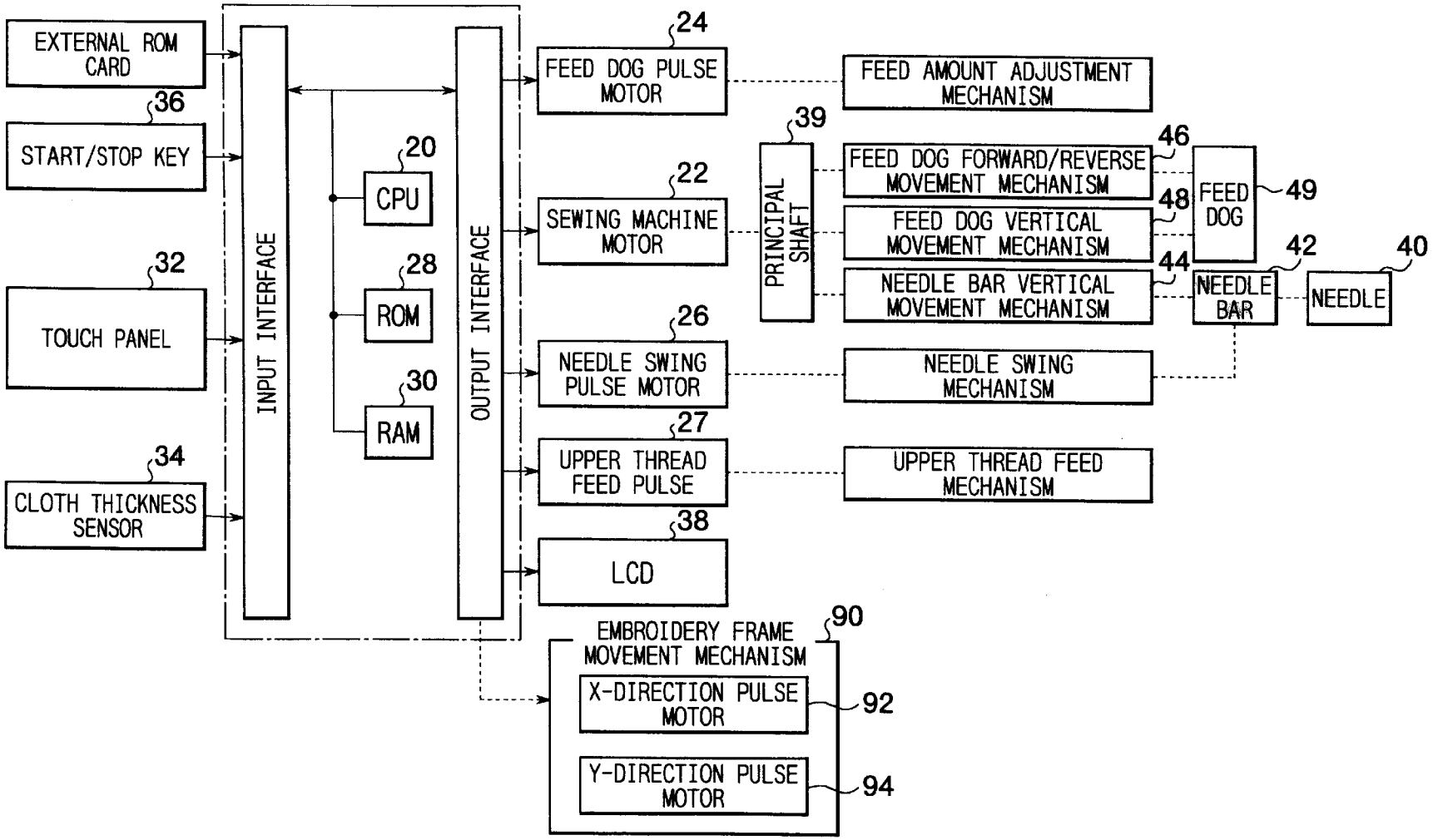
FIG. 3 is a block diagram showing electrical configuration of the sewing machine of FIG. 2.

As shown in FIG. 3, the sewing machine 1 includes a CPU 20, a RAM 28, and a RAM 30. The CPU 20 is connected, via an output interface, to a sewing machine motor 22, a feed dog pulse motor 24, a needle swing pulse motor 26, and an upper thread feed pulse motor 27. The CPU 20 controls drive of these motors according to a program stored in the RAM 28. The program is temporarily stored in the RAM 30 while the CPU 20 controls the motors.

The CPU 20 is also connected, via an input interface, to a touch panel 32, a cloth thickness sensor 34, and the start/stop key 36. The touch panel 32 enables the user to input the sewing conditions such as the tightness of the thread, the feed amount of the thread, the swing amount of the needle, and the pattern to be sewn. The cloth thickness sensor 34 is for detecting the thickness of the workpiece cloth based on the height of a presser bar or a presser foot, in order to calculate the amount of thread to be fed out.

The sewing machine motor 22 is connected to a principle shaft 33, which in turn is connected to a feed dog forward/reverse movement mechanism 46, a feed dog vertical movement mechanism 48, and a needle bar vertical movement mechanism 44. A feed dog 49 is connected to the feed dog forward/reverse movement mechanism 46 and the feed dog vertical movement mechanism 48. A needle bar 42 is connected to the needle bar vertical movement mechanism 44. A needle 40 is attached to the needle bar 42.

With this configuration, operation of the sewing machine 22 rotates the principle shaft 39 so that the needle 40, the needle bar 42, the needle bar vertical movement mechanism 44, the feed dog forward/reverse movement mechanism 46, the feed dog vertical movement mechanism 48, and the feed dog 48 operate according to the designated sewing conditions. The tightness of the thread is determined based on the amount that the upper thread is fed out. This upper thread feed amount is calculated based on the thickness of the workpiece cloth, the movement amount of the workpiece cloth, the amount of needle swing, and the like.

Figure 4:
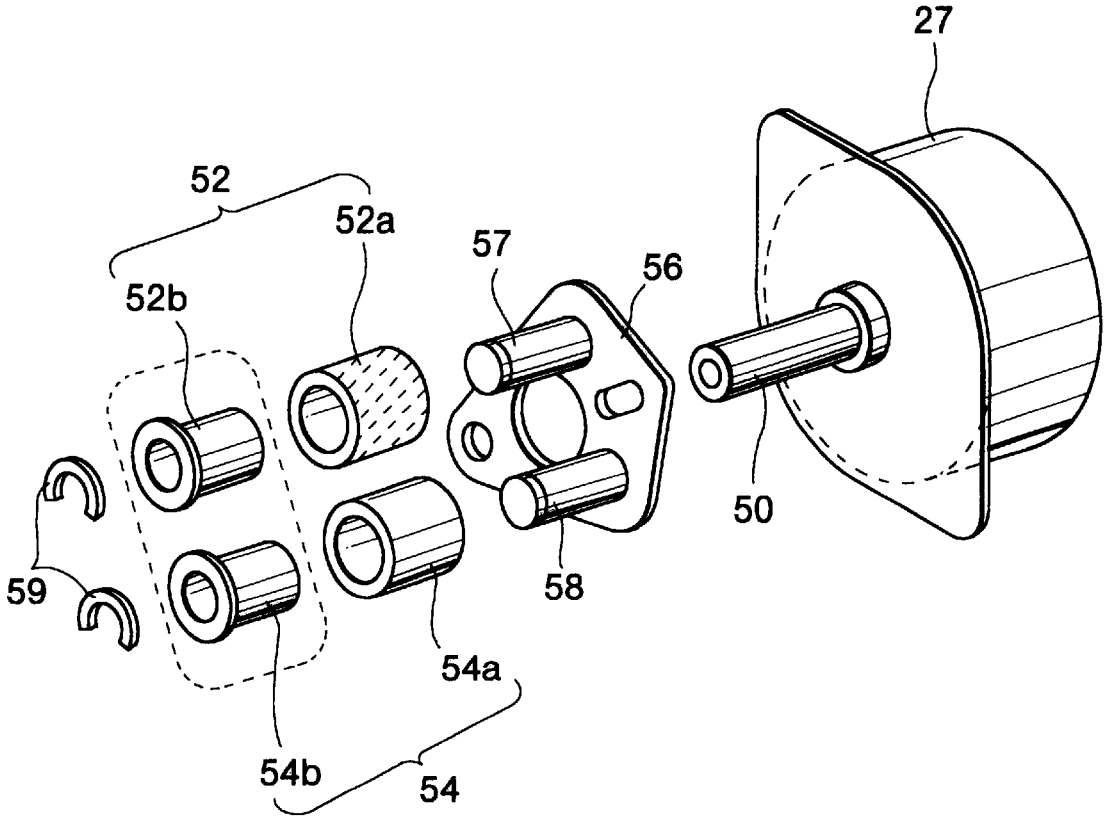
FIG. 4 is an exploded prospective view showing an upper thread supply device of the sewing machine of FIG. 2.

As shown in FIG. 4, a drive roller 50 is integrally fixed directly to the drive shaft of the upper thread feed drive motor 27. The drive roller 50 is formed in a cylindrical shape from a quenched-hardened hard metal such as iron. The outer peripheral surface of the drive roller 50 has been processed by sandblasting or shot blasting to increase or stabilize the friction coefficient at the outer surface of the drive roller 50.

A support plate 56 formed with a through hole is disposed adjacent to the drive motor 27. The drive roller 50 is inserted through the through hole of the support plate 56. Support members 57, 58 are formed to the support plate 56 so as to protrude substantially in parallel with the drive roller 50.

Figure 5:
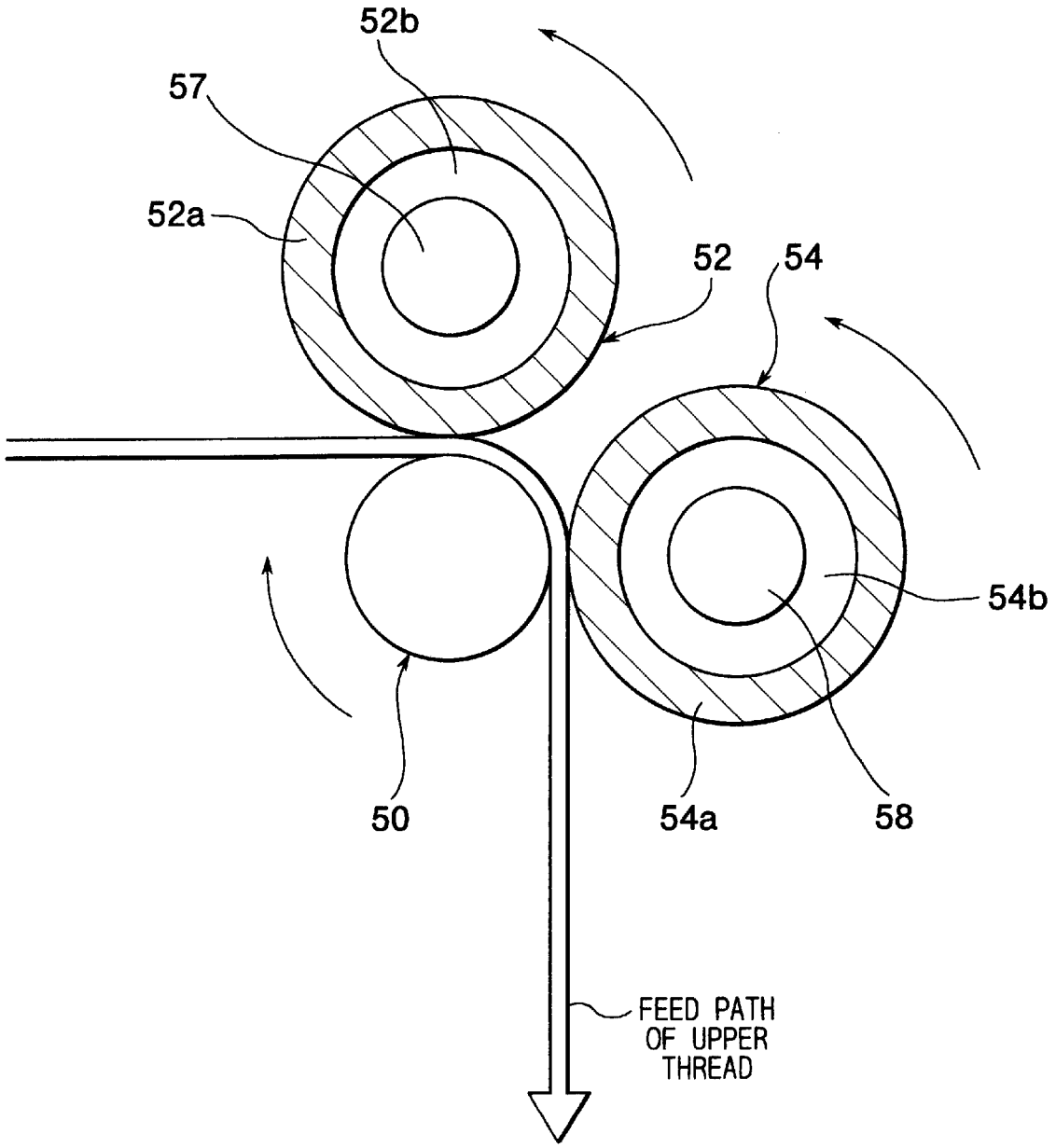
FIG. 5 is a side view in partial cross section showing components of the upper thread supply device of FIG. 4.

Slave rollers 52, 54 are rotatably disposed on the support members 57, 58, respectively, in confrontation with the drive roller 50 as shown in FIG. 5. The slave roller 52 includes a thread contacting portion 52*a* and a resin portion 52*b* for supporting the thread contacting portion 52*a* on the support member 57. Similarly, the slave roller 54 includes a thread contacting portion 54*a*, and a resin portion 54*b* for supporting the thread contacting portion 54*a* on the support member 58. The slave rollers 52, 54 are prevented from falling off the support members 57, 58 by stopper rings 59.

Figure 6:
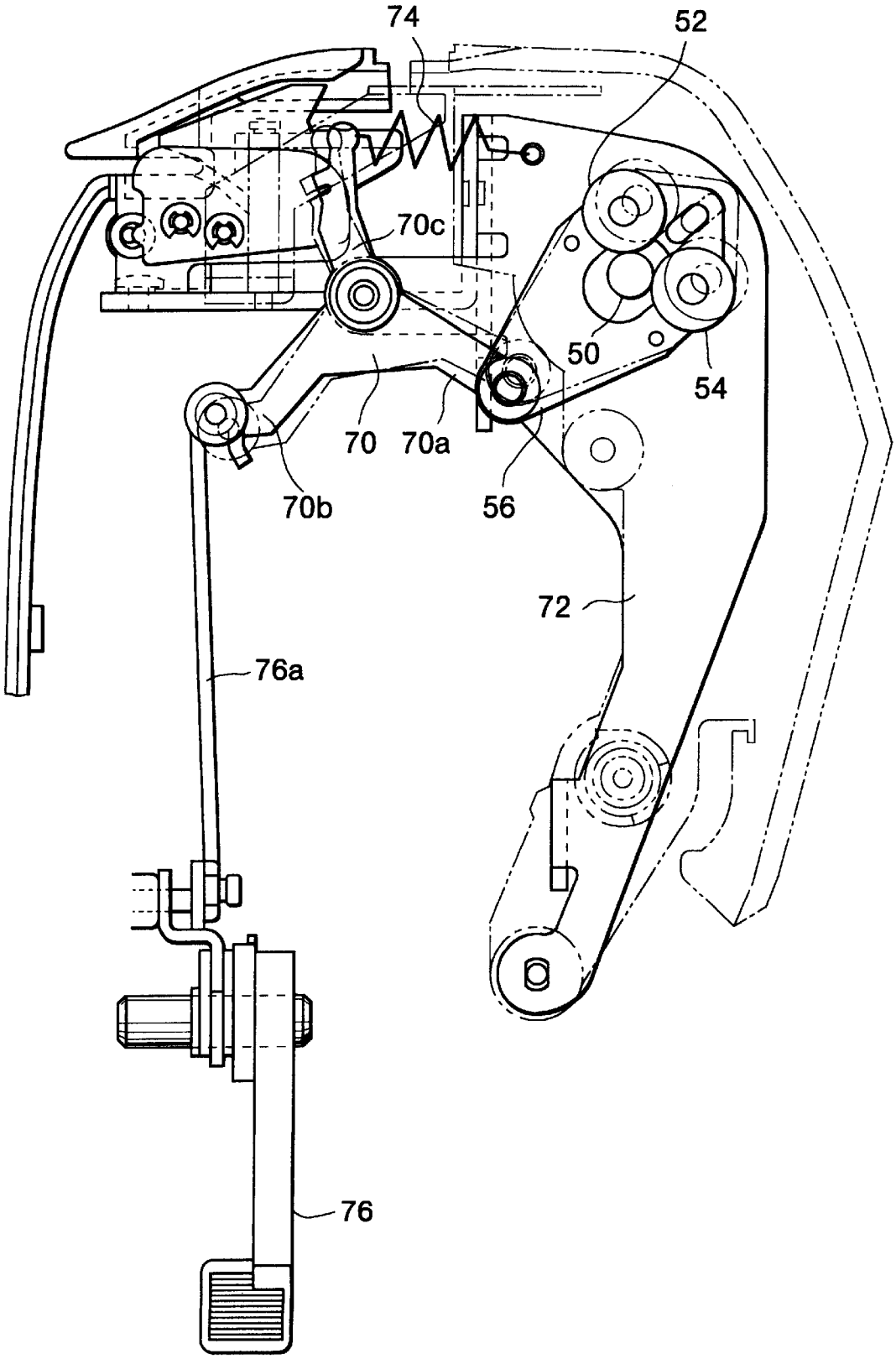
FIG. 6 is a schematic view of the upper thread supply device of FIG. 4.

Configuration to be described later with reference to FIG. 6 is provided for moving the slave rollers 53, 54 toward and away from the drive roller 50. While the slave rollers 52, 54 are disposed in contact with the drive roller 50, an upper thread sandwiched between the drive roller 50 and the slave rollers 52, 54 is held fast in place when the rollers are stopped and is fed out when the rollers are rotated.

The first and second slave rollers 52, 54 are disposed in contact with the single drive roller 50, and are separated from each other, upstream and downstream, respectively, with respect to the pathway traveled by the upper thread. Said differently, the first and second slave rollers 52, 54 are disposed in front of and behind, respectively, the drive roller 50 with respect to the pathway traveled by the upper thread.

As mentioned above, the first slave roller 52 includes the thread contacting portion 52*a* and the resin portion 52*b*. The thread contacting portion 52*a* is formed in a hollow tubular shape from a softer metal than the hard metal of the drive roller 50, such as sintered copper. The soft metal has not been subjected to quench hardening. The resin portion 52*b* is formed from resin in a cylindrical shape that fits in the hollow center of the thread contacting portion 52*a*, so that the thread contacting portion 52*a* and the resin portion 52*b* rotate integrally with each other. The outer peripheral surface of the thread contacting portion 52*a* is processed by sandblasting or shot blasting to increase or stabilize the friction coefficient thereof.

As mentioned above, the second slave roller 54 includes the thread contacting portion 54*a* and the resin portion 54*b*. The thread contacting portion 54*a* is formed in a hollow tubular shape from durable and heat-resistant urethane rubber, which is hardened by heating. Therefore, even though the drive motor 27 and the slave rollers 52, 54 are disposed adjacent to each other, the slave rollers 52, 54 will not be adversely effected by heat generated from the drive motor 27, so that thread feed can be reliably performed for a long period of time. Also, the urethane rubber shows greater adhesion than the metal rollers, and so feeds the upper thread with greater accuracy than the metal contacting portion 52*a*. Further, the urethane rubber of the thread contacting portion 54*a* is softer than both the hard metal of the drive roller 50 and the soft metal of the slave roller 52.

The resin portion 54*b* is formed from resin into a cylindrical shape that fits in the hollow center of the thread contacting portion 54*a*, so that the thread contacting portion 54*a* and the resin portion 54*b* rotate integrally with each other. The outer peripheral surface of the thread contacting portion 54*b* has been processed by sandblasting to increase or stabilize the friction coefficient thereof.

According to the present embodiment, the thread contacting portion 54*b* is first formed, and then the outer surface of the thread contacting portion 54*b* is sandblasted or shot blasted to roughen the outer surface. However, the outer surface of the thread contacting portion 54*b* could be roughened when the thread contacting portion 54*b* is formed, if the mold for forming the thread contacting portion 54*b* is subjected to sandblasting or shot blasting to roughen the inner surface of the mold.

With the above-described configuration, the thread contacting portions 52*a*, 54*a*, and the drive roller 50, which also serves as a thread contacting portion, all have different hardnesses, in the order of the thread contacting portion of the drive roller 50 being the hardest, the thread contacting portion 52*a* of the first slave roller 52 being next hardest, and the thread contacting portion 54*a* of the second slave roller 54 being the least hard.

The drive roller 50 is made harder than the slave rollers 52, 54, because the roller is subjected to most severe abrasion conditions. Which roller is subjected to the most severe abrasion conditions depends on pressure P applied to the rollers and on the rotation ratio V of the rollers. Because in the present embodiment the drive roller 50 is smaller than the slave rollers 52, 54, the drive roller 50, which is directly fixed to the motor shaft, is subjected to abrasion conditions much worse and more severe than those of the slave rollers 52, 54. If the drive roller 50 is abraded, slave rollers 52, 54 are also adversely affected because drive roller 50 is the drive source for the slave rollers 52, 54. Slips, and resultant thread tangles and defective stitches, can occur. Also, because of the drive roller 50 is attached directly to the roller motor, it is not easy to exchange. Because the hardness of the drive roller 50 is greater than that of the thread contacting portions 52*a*, 54*a* of the first and second slave rollers 52, 54, the thread contacting portion that is subjected to the greatest abrasion force, and that most greatly shows the effects of abrasion, has the greatest endurance to abrasion. Also, the drive roller will not need to be replaced often, which is convenient because the drive roller is attached directly to the motor shaft, and so is difficult to exchange.

Because the thread is sandwiched between two metal rollers, that is, the drive roller 50 and the first roller 52, the upper thread is reliably held, so that the upper thread is not excessively drawn from the upper thread spool. Because the metal rollers have different hardnesses, the softer roller can reliably and accurately fed out the thread, so that thread tangling can be prevented. Because two metal rollers are used, both have greater endurance against abrasion of the upper thread than if they were formed from rubber or resin. Therefore, the rollers will not be scratched or damaged by abrasion with the thread. As a result, no jagged portions that can cut the thread will form on the surface of the rollers.

Of the two thread contacting portions 52*a*, 54*a*, which are upstream and downstream respectively with respect to the pathway followed by the thread, the upstream-side thread contacting portion 52*a* is formed with a hardness greater than the downstream-side thread contacting portion 54*a*. Also, as mentioned previously, the hard metal of the drive roller 50 has hardness greater than the soft metal of the upstream-side thread contacting portion 52*a*, and the soft metal of the upstream-side thread contacting portion 52*a* has a hardness greater than the resilient downstream-side thread contacting portion 54*a*.

Because the thread contacting portions 52*a*, 54*a* have different hardnesses, each is better suited to fill a particular role. That is, the soft metal thread contacting portion 52*a* mainly prevents excessive upper thread from being drawn out of the upper thread spool by vertical movement of the thread take-up lever, and the resilient thread contacting portion 54*a* mainly functions to accurately draw upper thread out from the upper thread spool.

The upper thread is sandwiched at two different sandwich positions separated from each other upstream and downstream of the drive roller 50 along the thread-feed pathway, that is, at an upstream position between the drive roller 50 and the upstream-side thread contacting portion 52*a*, and at a downstream position between the drive roller 50 and the downstream-side thread contacting portion 54*a*. In other words, according to the present embodiment, the configuration for preventing excessive upper thread from being drawn out is disposed upstream from the configuration for drawing the upper thread out from the upper thread spool.

The slave rollers 52, 54 are rotatably disposed on support members 57, 58 respectively, which protrude from the support plate 56. The slave rollers 52, 54 are prevented from falling off the support members 57, 58 by stopper rings 59. The thread contacting portions 52*a*, 54*a* are supported on the support members 57, 58 via resin portions 52*b*, 54*b*, respectively. Said differently, the members rotated by rotation of the drive roller 50, that is, the thread contacting portions 52*a*, 54*a*, are supported on a fixed member, that is, the support plate 56, via the resin portions 52*b*, 54*b*. Problems, such as friction scorching, noise, and vibration caused by roller rotation during thread feed can be prevented. Because there is no need to apply grease or other lubrication, the thread can be kept free from oil contamination.

As shown in FIG. 6, a swing member 70 is rotatably attached to a motor support plate 70, on which the drive motor 27 is fixed. The swing member 70 has three arms 70*a*, 70*b*, and 70*c*. The rightward extending arm 70*a* is attached to the lower left edge of the support plate 56 by a through hole and pin configuration to enable pivoting movement between the swing member 70 and the support plate 56.

The upward extending arm 70*c* is connected to the motor support plate 72 by a resilient pulling spring 74, which urges the swing member 70 to rotate clockwise as viewed in FIG. 6 so that the two slave roller 52, 54 press into contact with the drive roller 50.

The leftward extending arm 70*b* is attached to a pressing member 76 by a metal rod 76*a*. With this configuration, when the pressing member 76 is pressed downwards, the metal rod 76*a* raises upwards, thereby separating the slave rollers 52, 54 from the drive roller 50 against the urging force of the pulling spring 74, as indicated by a two-dot chain line in FIG. 6.

The CPU 20 calculates how much the upper thread should be fed out based on user settings and detected thickness of the workpiece cloth. User settings include tightness of the thread, amount the thread is fed out, amount the needle swings, and the pattern to be sewn. The drive motor 27 rotates clockwise as viewed in FIG. 5 based on the calculation results of the CPU 20 to form stitches with good thread adjustment.

While the invention has been described in detail with reference to specific embodiments thereof, it would be apparent to those skilled in the art that various changes and modifications may be made therein without departing from the spirit of the invention, the scope of which is defined by the attached claims.

For example, the embodiment described two slave rollers 52, 54 disposed adjacent to a single drive roller 50. However, a single slave roller can be provided adjacent to the single drive roller 50. In this case, it is desirable that the drive roller 50 be formed from a hard metal, and the slave roller be formed from a resilient body. The outer surface of the drive roller 50 can be subjected to sandblasting or shot blasting to increase or stabilize the friction coefficient. However, in this case, an electromagnetic solenoid needs to be provided for preventing the upper thread from being excessively drawn out. The electromagnetic solenoid can be provided with a pair of thread contacting portions for sandwiching the upper thread, wherein one of the thread contacting portions is formed from a soft metal and the other thread contacting portion is formed from a hard metal.

A certain amount of roughness at the outer surface of the drive roller 50 is desirable to insure proper feeding of the thread. That is, if the outer surface of the drive roller 50 were perfectly smooth, the thread would easily slip because of dust or other material on the drive roller 50. This is the same reason why automobile tires need to be formed with grooves to provide sufficient gripping action. If the outer surface of the drive roller 50 was not sandblasted or shot blasted to increase its roughness, then the surface of the drive roller 50 would soon be worn down to a smooth surface and slips would easily occur. On the other hand, when outer surface of the drive roller 50 is subjected to sandblasting or shot blasting, the difference between peaks and valleys on the surface of the drive roller 50 is increased, so that the time required for the outer surface to wear down so a smooth surface increases. Therefore, sufficient endurance of the drive roller can be obtained by the surface processing. Because the drive roller has greater durability, and does not need to be replaced as often, the drive roller can be directly attached to the drive shaft of the drive motor.

Although all thread contacting portions, that is, the thread contacting portion of the drive roller 50 and the thread contacting portions 52*a*, 54*a*, are subjected to surface processing, such as a sandblasting or shot blasting, for increasing or stabilizing friction coefficient, only a portion of the thread contacting portions needs to be subjected to such surface processing.

Although in the present embodiment the drive roller 50 is harder than the slave roller 52 and the slave roller 52 is harder than the slave roller 54, the upper thread can be properly and accurately held as long as the hardness of the two slave rollers 52, 54 are different. That is, when the slave rollers have different hardnesses, the softer one is well suited for feeding out the thread, and the harder one is well suited for preventing excessive thread from being pulled off spool. Therefore, when the two rollers have different hardnesses, each can perform one of the roles well, so that overall ability to hold the thread is improved.

As a result, the order of hardness can be the opposite, that is, the slave roller 54 can be harder than the slave roller 52. That is, the soft metal thread contacting portion 52*a* could be disposed downstream from the resilient thread contacting portion 54*a* instead. This configuration positions the resilient thread contacting portion 54*a* closer to the upper thread spool, which is further upstream. Because the resilient thread contacting portion 54*a* serves to reliably draw the upper thread from the upper thread spool, this order of soft-metal and resilient rollers insures that the upper thread is reliably drawn from the upper thread spool.

Similarly, this configuration positions the soft metal thread contacting portion 52*a* closer to the thread take-up lever, which is further downstream. Because the soft metal thread contacting portion 52*a* serves to reliably prevent excessive thread from being pulled off the upper thread spool by operation of the thread take-up lever, this order of soft-metal and resilient rollers reliably prevents excessive thread from being pulled off the upper thread.

It should be noted that the optimum positional relationship of the soft and hard rollers, that is, which is disposed upstream and which is disposed downstream, is determined based on a variety of factors, such as whether the rollers are aligned vertically or horizontally, whether the thread is to be fed in vertically or horizontally, and the magnitude of the burden placed by the thread on the roller nearest the thread take-up lever.

Although the thread contacting portions of the drive roller 50 and the slave roller 52, 54 are described as having a curved surface, the thread contacting portions can have an uneven surface such as a geared surface.

The embodiment described the slave rollers 52, 54 as being fixed to the stationary support members 57, 58 via resin portions 52*b*, 54*b*. However, the slave rollers 52, 54 can be fixed to a rotating shaft, for example. In this case, the resin portion can be provided to the rotating shaft or to the bearing portion of the rotation shaft. Such a configuration can prevent sound and vibration that accompanies roller rotation and can prevent oil contamination of the upper thread.

The embodiment described providing a resin portion between rotating and stationary portions of the rollers. However, a bearing can be provided instead of the resin portions. It should be noted that the thread contacting portions and resin portions can be formed separately and then combined, or can be formed together using insert formation techniques.

The portion of the drive roller that contacts the thread can be formed from any material having a high degree of hardness such as a ceramic material. The anti-abrasion properties of the thread contacting portion of the rollers can be increased by Kevlar (trademark). The hard metal need only be harder than the soft metal, and so can alternately be formed from stainless steel, titanium, or other metal depending on the hardness of the soft metal. The soft metal can be formed from any metal softer than the thread contacting portion of the drive roller. Examples of other soft metals include gold, aluminum, brass, and silver. The resilient portion of the roller that contacts the thread can be formed from silicon rubber or fluoro rubber, instead of urethane rubber.

The sewing machine 1 can be provided with a detachable embroidery frame movement mechanism 90. With this configuration, the workpiece cloth is moved by X and Y pulse motors 92, 94 rather than by the feed dog 49. However, in this case the pressing force for moving the workpiece cloth needs to be reduced. Therefore, thickness of the cloth is set to a predetermined value and the thread feed amount is calculated, regardless of the height of the pressing bar.

Figure 7:
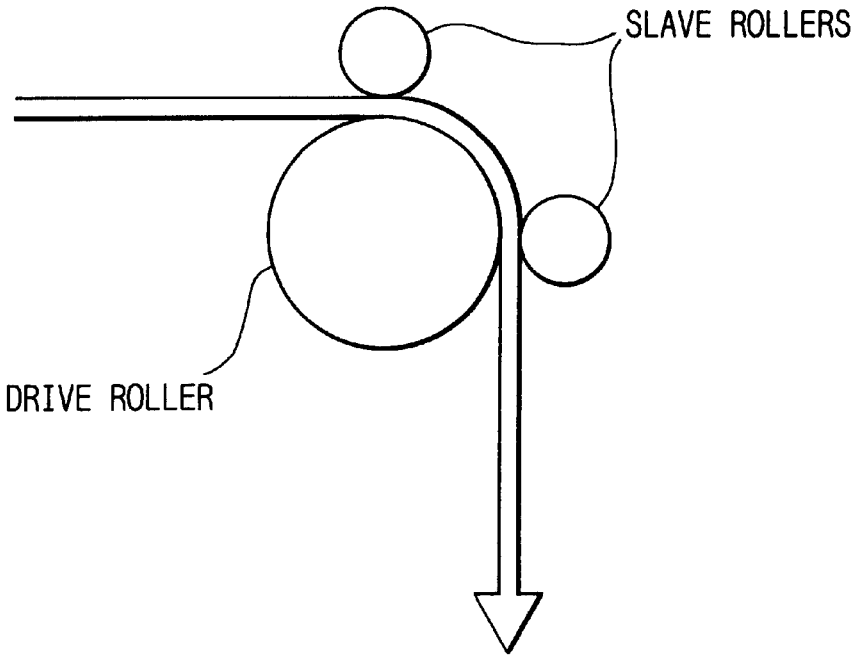
FIG. 7 is a side view showing an upper thread supply device according to a modification of the embodiment, wherein a drive roller has a larger diameter (rotational ratio) than the slave rollers.

The slave rollers can be formed smaller than the drive roller as shown in FIG. 7. In this case, then the slave rollers will be subjected to the most severs abrasion conditions. Therefore, in this case it is desirable to form the slave rollers from a harder material than the drive roller. For example, the slave rollers could be formed from a quench-hardened metal and the drive roller could be formed from a non-quench-hardened metal. Alternatively, one or both of the slave rollers could be formed from a quench-hardened or non-quench-hardened metal, and the drive roller could be formed from a resilient material such as rubber.

Figure 8:
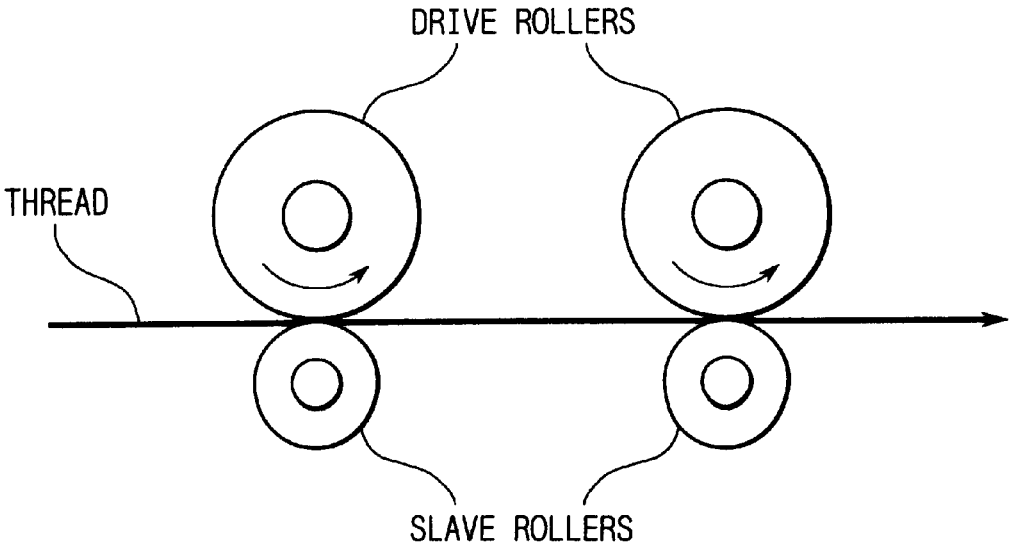
FIG. 8 is a side view showing an upper thread supply device according to another modification of the embodiment, wherein two drive rollers are provided, one in confrontation with a different one of the slave rollers.

As shown in FIG. 8, two drive rollers can be provided instead of only one. In this case, each drive roller is disposed in confrontation with a different one of the slave rollers and the two drive rollers are driven in synchronization. Which of the rollers, that is, the drive rollers and the slave rollers, is harder or softer than the others, is determined based on whether the drive rollers are aligned horizontally, vertically, or in some other appropriate orientation, whether the drive rollers are disposed above or below the slave rollers, and whether the drive rollers are formed larger or smaller than the slave rollers, among other factors.

What is claimed is:

1. An upper thread supply device for transporting an upper thread in a sewing machine, comprising:

a drive roller driven to rotate by a drive source and having a thread contacting portion;

a first slave roller having a thread contacting portion disposed in contact with the thread contacting portion of the drive roller, in order to support the upper thread between the thread contacting portions of the drive roller and the first slave roller and to transport the upper thread by rotation of the drive roller; and a second slave roller having a thread contacting portion disposed in contact with the thread contacting portion of the drive roller, in order to support the upper thread between the thread contacting portions of the drive roller and the second slave roller and to transport the upper thread by rotation of the drive roller, wherein hardness of the thread contacting portion of the first slave roller and hardness of the second thread contacting portion of the second slave roller are different from each other, wherein the thread contacting portion of the drive roller has hardness different from the hardness of the thread contacting portion of the first slave roller and from the hardness of the thread contacting portion of the second slave roller.

2. An upper thread supply device as claimed in claim 1, wherein the hardness of the thread contacting portion of the drive roller is greater than the hardness of the thread contacting portion of the first slave roller and greater than the hardness of the thread contacting portion of the second slave roller.

3. An upper thread supply device as claimed in claim 2, wherein the first slave roller is disposed upstream from the second slave roller with respect to a thread feed pathway followed by the upper thread between the drive roller and the first and second slave rollers by rotation of the drive roller.

4. An upper thread supply device as claimed in claim 3, wherein the hardness of the thread contacting portion of the first slave roller is greater than the hardness of the thread contacting portion of the second slave roller.

5. An upper thread supply device as claimed in claim 2, wherein the drive roller has a smaller outer diameter than either of the slave rollers.

6. An upper thread supply device as claimed in claim 1, wherein the first slave roller is disposed upstream from the second slave roller with respect to a thread feed pathway followed by the upper thread, wherein the hardness of the thread contacting portion of the first slave roller is greater than the hardness of the thread contacting portion of the second slave roller.

7. An upper thread supply device as claimed in claim 1, wherein the hardness of the thread contacting portion of the first slave roller is greater than the hardness of the thread contacting portion of the second slave roller, so that the first slave roller mainly functions to hold the upper thread fast between itself and the drive roller when the drive roller is stopped, and the second slave roller mainly functions to transport the upper thread when the drive roller rotates.

8. An upper thread supply device as claimed in claim 1, wherein the first slave roller is disposed upstream from the second slave roller with respect to a thread feed pathway followed by the upper thread between the drive roller and the first and second slave rollers by rotation of the drive roller, the thread contacting portion of the drive roller is formed from a quench-hardened metal, the thread contacting portion of the first slave roller is formed from a non-quench-hardened metal, and the thread contacting portion of the second slave roller is formed from a resilient material that is less hard than the non-quench-hardened metal of the thread contacting portion of the first slave roller.

9. An upper thread supply device as claimed in claim 8, wherein the thread contacting portion of the second slave roller is disposed near a drive motor for driving rotation of the drive roller, and is formed from a heat resistant resilient material.

10. An upper thread supply device as claimed in claim 1, wherein the thread contacting portion of the drive roller is formed from a quench-hardened metal.

11. An upper thread supply device as claimed in claim 10, wherein the drive roller has a smaller outer diameter than either of the slave rollers.

12. An upper thread supply device as claimed in claim 1, wherein at least one of the thread contacting portions is subjected to surface treatment to increase or stabilize friction coefficient.

13. An upper thread supply device as claimed in claim 12, wherein the surface treatment includes sandblasting or shot blasting.

14. An upper thread supply device as claimed in claim 1, wherein at least one of first and second slave rollers includes:

a rotation portion that rotates in association with rotation of the drive roller;

a stationary portion that remains stationary despite rotation of the drive roller; and a resin portion for enhancing sliding movement between the rotation portion and the stationary portion.

15. An upper thread supply device for transporting an upper thread in a sewing machine, comprising:

a drive roller driven to rotate by a drive source; and a slave roller in contact with the drive roller so as to support the upper thread between the drive roller and the slave roller and to feed the upper thread by rotation of the drive roller, wherein one of the drive roller and the slave roller has a thread contacting portion formed from a quench-hardened metal and another of the drive roller and the slave roller has a thread contacting portion formed from a non-quench-hardened metal, so that hardness of the thread contacting portion of the drive roller and hardness of the thread contacting portion of the slave roller are different from each other.

16. An upper thread supply device as claimed in claim 15, further comprising a resilient roller having a resilient thread contacting portion in contact with the drive roller, for feeding the upper thread between the drive roller and the resilient roller by rotation of the drive roller.

17. An upper thread supply device as claimed in claim 16, wherein the resilient roller is disposed downstream from the drive roller and the slave roller with respect to a thread feed pathway followed by the upper thread between the drive roller and the first slave roller, and between the drive roller and the resilient roller, by rotation of the drive roller.

18. An upper thread supply device as claimed in claim 16, wherein the resilient body is disposed near a drive motor for driving rotation of the drive roller, and is formed from a heat resistant material.

19. An upper thread supply device as claimed in claim 15, wherein the drive roller has a thread contacting portion formed from a quench-hardened metal.

20. An upper thread supply device as claimed in claim 19, wherein the drive roller has a smaller outer diameter than either of the slave rollers.

21. An upper thread supply device as claimed in claim 19, further comprising a drive motor serving as the drive source, the drive roller being attached directly to a drive shaft of the drive motor.

22. An upper thread supply device as claimed in claim 15, wherein one of the thread contacting portions is subjected to surface treatment to increase or stabilize friction coefficient.

23. An upper thread supply device as claimed in claim 22, wherein the surface treatment includes sandblasting or shot blasting.

24. An upper thread supply device as claimed in claim 15, wherein the slave roller includes:

a rotation portion that rotates in association with rotation of the drive roller;

a stationary portion that remains stationary despite rotation of the drive roller; and a resin portion for enhancing sliding movement between the rotation portion and the stationary portion.

25. An upper thread supply device for transporting an upper thread in a sewing machine, comprising:

a first roller set for transporting the upper thread, and including:

a first drive roller driven to rotate and having a thread contacting portion; and a first slave roller having a thread contacting portion disposed in contact with the thread contacting portion of the first drive roller, in order to support the upper thread between the thread contacting portions of the first drive roller and the first slave roller and to transport the upper thread by rotation of the first drive roller; and a second roller set disposed either upstream or downstream from the first roller set with respect to a thread feed pathway followed by the upper thread, and including:

a second drive roller driven to rotate and having a thread contacting portion; and a second slave roller having a thread contacting portion disposed in contact with the thread contacting portion of the second drive roller, in order to support the upper thread between the thread contacting portions of the second drive roller and the second slave roller and to transport the upper thread by rotation of the second drive roller;

wherein hardness of the thread contacting portion of the first slave roller and hardness of the thread contacting portion of the second slave roller are different from each other.

26. An upper thread supply device as claimed in claim 25, wherein the thread contacting portions of the first and second drive rollers have hardnesses different from the hardness of the thread contacting portion of the first slave roller and from the hardness of the thread contacting portion of the second slave roller.

27. An upper thread supply device as claimed in claim 26, wherein the hardness of the thread contacting portion of each drive roller is greater than the hardness of the thread contacting portion of the first slave roller and greater than the hardness of the thread contacting portion of the second slave roller.

28. An upper thread supply device as claimed in claim 27, wherein the first roller set is disposed upstream from the second roller set with respect to the thread feed pathway followed by the upper thread by rotation of the drive rollers.

29. An upper thread supply device as claimed in claim 28, wherein the hardness of the thread contacting portion of the first slave roller is greater than the hardness of the thread contacting portion of the second slave roller.

30. An upper thread supply device as claimed in claim 27, wherein each drive roller has a smaller outer diameter than either of the slave rollers.

31. An upper thread supply device as claimed in claim 25, wherein the first roller set is disposed upstream from the second roller set with respect to the thread feed pathway followed by the upper thread by rotation of the drive rollers, wherein the hardness of the thread contacting portion of the first slave roller is greater than the hardness of the thread contacting portion of the second slave roller.

32. An upper thread supply device as claimed in claim 25, wherein the hardness of the thread contacting portion of the first slave roller is greater than the hardness of the thread contacting portion of the second slave roller, so that the first roller set mainly functions to hold the upper thread fast when the first drive roller is stopped, and the second roller set mainly functions to transport the upper thread by rotation of the second drive roller.

33. An upper thread supply device as claimed in claim 25, wherein the first roller set is disposed upstream from the second roller set with respect to the thread feed pathway followed by the upper thread, the thread contacting portions of the drive rollers are formed from a quench-hardened metal, the thread contacting portion of the first slave roller is formed from a non-quench-hardened metal, and the thread contacting portion of the second slave roller is formed from a resilient material that is less hard than the non-quench-hardened metal of the thread contacting portion of the first slave roller.

34. An upper thread supply device as claimed in claim 33, wherein the thread contacting portion of the second slave roller is disposed near a drive motor for driving rotation of one of the drive rollers, and is formed from a heat resistant resilient material.

35. An upper thread supply device as claimed in claim 25, wherein the thread contacting portions of the drive rollers are formed from a quench-hardened metal.

36. An upper thread supply device as claimed in claim 35, wherein each drive roller has a smaller outer diameter than either of the slave rollers.

37. An upper thread supply device as claimed in claim 25, wherein at least one of the thread contacting portions is subjected to surface treatment to increase or stabilize friction coefficient.

38. An upper thread supply device as claimed in claim, 37, wherein the surface treatment includes sandblasting or shot blasting.

39. An upper thread supply device as claimed in claim 25, wherein at least one of first and second slave rollers includes:

a rotation portion that rotates in association with rotation of a corresponding drive roller;

a stationary portion that remains stationary despite rotation of a corresponding drive roller; and a resin portion for enhancing sliding movement between the rotation portion and the stationary portion.

40. An upper thread supply device for transporting an upper thread in a sewing machine, comprising:

a drive roller driven to rotate by a drive source and having a thread contacting portion;

a first slave roller having a thread contacting portion disposed in contact with the thread contacting portion of the drive roller, in order to support the upper thread between the thread contacting portions of the drive roller and the first slave roller and to transport the upper thread by rotation of the drive roller; and a second slave roller having a thread contacting portion disposed in contact with the thread contacting portion of the drive roller, in order to support the upper thread between the thread contacting portions of the drive roller and the second slave roller and to transport the upper thread by rotation of the drive roller, wherein hardness of the thread contacting portion of the first slave roller and hardness of the second thread contacting portion of the second slave roller are different from each other, wherein the first slave roller is disposed upstream from the second slave roller with respect to a thread feed pathway followed by the upper thread, wherein the hardness of the thread contacting portion of the first slave roller is greater than the hardness of the thread contacting portion of the second slave roller.

41. An upper thread supply device for transporting an upper thread in a sewing machine, comprising:

a drive roller driven to rotate by a drive source and having a thread contacting portion;

a first slave roller having a thread contacting portion disposed in contact with the thread contacting portion of the drive roller, in order to support the upper thread between the thread contacting portions of the drive roller and the first slave roller and to transport the upper thread by rotation of the drive roller; and a second slave roller having a thread contacting portion disposed in contact with the thread contacting portion of the drive roller, in order to support the upper thread between the thread contacting portions of the drive roller and the second slave roller and to transport the upper thread by rotation of the drive roller, wherein hardness of the thread contacting portion of the first slave roller and hardness of the second thread contacting portion of the second slave roller are different from each other, wherein the first slave roller is disposed upstream from the second slave roller with respect to a thread feed pathway followed by the upper thread between the drive roller and the first and second slave rollers by rotation of the drive roller, the thread contacting portion of the drive roller is formed from a quench-hardened metal, the thread contacting portion of the first slave roller is formed from a non-quench-hardened metal, and the thread contacting portion of the second slave roller is formed from a resilient material that is less hard than the non-quench-hardened metal of the thread contacting portion of the first slave roller.

42. As upper thread supply device as claimed in claim 41, wherein the thread contacting portion of the second slave roller is disposed near a drive motor for driving rotation of the drive roller, and is formed from a heat resistant resilient material.

43. An upper thread supply device for transporting an upper thread in a sewing machine, comprising:

a drive roller driven to rotate by a drive source and having a thread contacting portion;

a first slave roller having a thread contacting portion disposed in contact with the thread contacting portion of the drive roller, in order to support the upper thread between the thread contacting portions of the drive roller and the first slave roller and to transport the upper thread by rotation of the drive roller; and a second slave roller having a thread contacting portion disposed in contact with the thread contacting portion of the drive roller, in order to support the upper thread between the thread contacting portions of the drive roller and the second slave roller and to transport the upper thread by rotation of the drive roller, wherein hardness of the thread contacting portion of the first slave roller and hardness of the second thread contacting portion of the second slave roller are different from each other, wherein at least one of first and second slave rollers includes:

a rotation portion that rotates in association with rotation of the drive roller;

a stationary portion that remains stationary despite rotation of the drive roller; and a resin portion for enhancing sliding movement between the rotation portion and the stationary portion.

44. An upper thread supply device for transporting an upper thread in a sewing machine, comprising:

a drive roller driven to rotate by a drive source and having a thread contacting portion;

a first slave roller having a thread contacting portion disposed in contact with the thread contacting portion of the drive roller, in order to support the upper thread between the thread contacting portions of the drive roller and the first slave roller and to transport the upper thread by rotation of the drive roller; and a second slave roller having a thread contacting portion disposed in contact with the thread contacting portion of the drive roller, in order to support the upper thread between the thread contacting portions of the drive roller and the second slave roller and to transport the upper thread by rotation of the drive roller, wherein hardness of the thread contacting portion of the first slave roller and hardness of the second thread contacting portion of the second slave roller are different from each other, wherein the thread contacting portion of the drive roller is formed from a quench-hardened metal.

45. An upper thread supply device as claimed in claim 44, wherein the drive roller has a smaller outer diameter than either of the slave rollers.

46. An upper thread supply device for transporting an upper thread in a sewing machine, comprising:

a drive roller driven to rotate by a drive source and having a thread contacting portion;

a first slave roller having a thread contacting portion disposed in contact with the thread contacting portion of the drive roller, in order to support the upper thread between the thread contacting portions of the drive roller and the first slave roller and to transport the upper thread by rotation of the drive roller; and a second slave roller having a thread contacting portion disposed in contact with the thread contacting portion of the drive roller, in order to support the upper thread between the thread contacting portions of the drive roller and the second slave roller and to transport the upper thread by rotation of the drive roller, wherein hardness of the thread contacting portion of the first slave roller and hardness of the second thread contacting portion of the second slave roller are different from each other, wherein at least one of the thread contacting portions is subjected to surface treatment to increase or stabilize friction coefficient.

47. An upper thread supply device as claimed in claim 46, wherein the surface treatment includes sandblasting or shot blasting.

* * * * *